United States Patent [19]

Krivec

[11] Patent Number: 4,970,922

[45] Date of Patent: Nov. 20, 1990

[54] TORQUE DRIVING TOOL AND RETAINER FOR DRIVEN MEMBER

[75] Inventor: Bert Krivec, Waukesha, Wis.

[73] Assignee: Snap-on Tools corporation, Kenosha, Wis.

[21] Appl. No.: 488,415

[22] Filed: Mar. 1, 1990

Related U.S. Application Data

[63] Continuation of Ser. No. 327,735, Mar. 23, 1989, abandoned.

[51] Int. Cl.[5] ..... B25B 15/00

[52] U.S. Cl. ..... 81/460; 81/451

[58] Field of Search ..... 81/441, 451, 460

[56] References Cited

U.S. PATENT DOCUMENTS

| | | | |
|---|---|---|---|
| 1,863,046 | 6/1932 | Githens et al. . | |
| 2,066,132 | 12/1936 | Zihler . | |
| 2,538,350 | 1/1951 | Baule . | |
| 2,800,936 | 7/1957 | West . | |
| 3,865,500 | 2/1975 | Newell . | |
| 4,187,892 | 2/1980 | Simmons . | |
| 4,191,228 | 3/1980 | Fenton . | |
| 4,269,246 | 5/1981 | Larson et al. | 81/460 |
| 4,464,957 | 8/1984 | Gill | 87/460 |

*Primary Examiner*—James G. Smith

*Attorney, Agent, or Firm*—Emrich & Dithmar

[57] ABSTRACT

A rotatable driving tool for imparting torque to a driven member, such as a threaded fastener having an axial recess in the head thereof, comprises a circularly cylindrical body with a plurality of substantially circularly helical driving portions projecting laterally therefrom and equiangularly spaced about the cylindrical axis, each of the driving portions having a small helix angle, preferably between one and three degress. The driving portions mate with lobes of the fastener recess but are slightly inclined with respect thereto to provide a wedge fit to retain the fastener in engagement with the tool body.

20 Claims, 1 Drawing Sheet

TORQUE DRIVING TOOL AND RETAINER FOR DRIVEN MEMBER

This is a continuation of application Ser. No. 327,735, filed Mar. 23, 1989 abandoned.

BACKGROUND OF THE INVENTION

1. Field of the Invention

The present invention relates generally to the field of torque driving tool apparatus and, more particularly, to a rotatable driving tool for imparting torque to a driven member, such as a threaded fastener. The invention also relates generally to the cooperation between the driving tool and a socket or recess in the driven member.

2. Description of the Prior Art

A typical torque driving tool apparatus includes a driving tool such as, for example, a screwdriver, which has a bit portion engageable in a complementary recess in the head of a rotatably driven member, such as a screw, bolt or the like. An area of concern in torque driving tool assemblies has been the retention of the fastener or other driven member on the bit of the driving tool. This may be important, for example, in applications where the driven member must be applied or mounted in an inaccessible location such that the only means available for delivering the fastener to the location and/or stabilizing it during the driving operation is the driving tool itself.

One type of retention technique is the use of a magnetized bit on the driving tool. This type of retention is, however, useful only with driven members which are formed of magnetic material.

One other approach has been to use a tapered bit on the driving tool which is adapted to wedge into an interference fit in the recess of the driven member. A disadvantage of such arrangements is that the bit engages the driven member only at the outer end of the recess. This results in inefficient transfer of the torque from the driving member to the driven member. Also, the concentration of force at one contact location tends to wear and deform the recess in the contact region. Furthermore, it has been found that very close tolerances are necessary in order to provide the proper wedge fit in a consistent manner.

SUMMARY OF THE INVENTION

It is a general object of the present invention to provide an improved rotatable torque transfer driving tool which avoids the disadvantages of prior tools while affording additional structural and operating advantages.

An important feature of the invention is the provision of a rotatable driving tool for imparting torque to a driven member, while providing an effective means for retaining the driven member in engagement on the driving tool.

In connection with the foregoing feature, it is another feature of the invention to provide a driving tool of the type set forth, which is effective for retaining the driven member irrespective of the material of which the driven member is made.

Still another feature of the invention is the provision of a driving tool of the type set forth, which does not require close tolerances.

Yet another feature of the invention is the provision of the combination of a driving tool of the type set forth and a driven member cooperating therewith.

These and other features of the invention are attained by providing a rotatable driving tool for imparting torque to a driven member, the tool comprising: a body having a longitudinal axis of rotation, and a plurality of substantially circularly helical driving portions projecting laterally from the body and equiangularly spaced about the axis and having a helix angle less than six degrees.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 3:
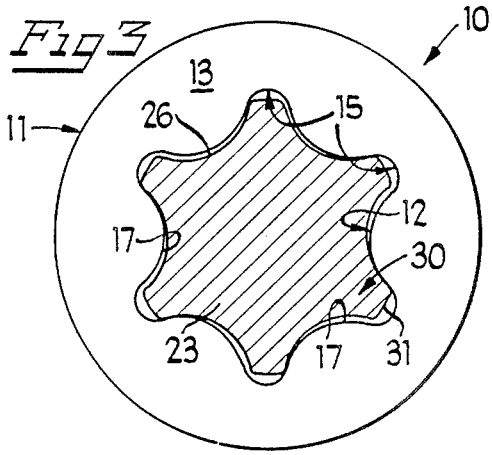
FIG. 3 is a top plan view of a driven member having a recess which is engaged with the bit portion of the tool of FIG. 1, which is illustrated in horizontal section.
Figure 4:
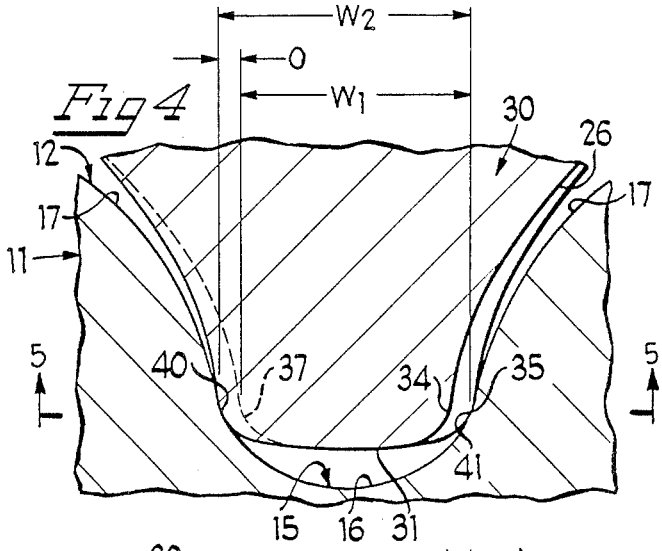
FIG. 4 is an enlarged, fragmentary view of one of the lobes of the fastener recess of FIG. 3, illustrating in greater detail the engagement of the bit blade in the lobe.
Figure 5:
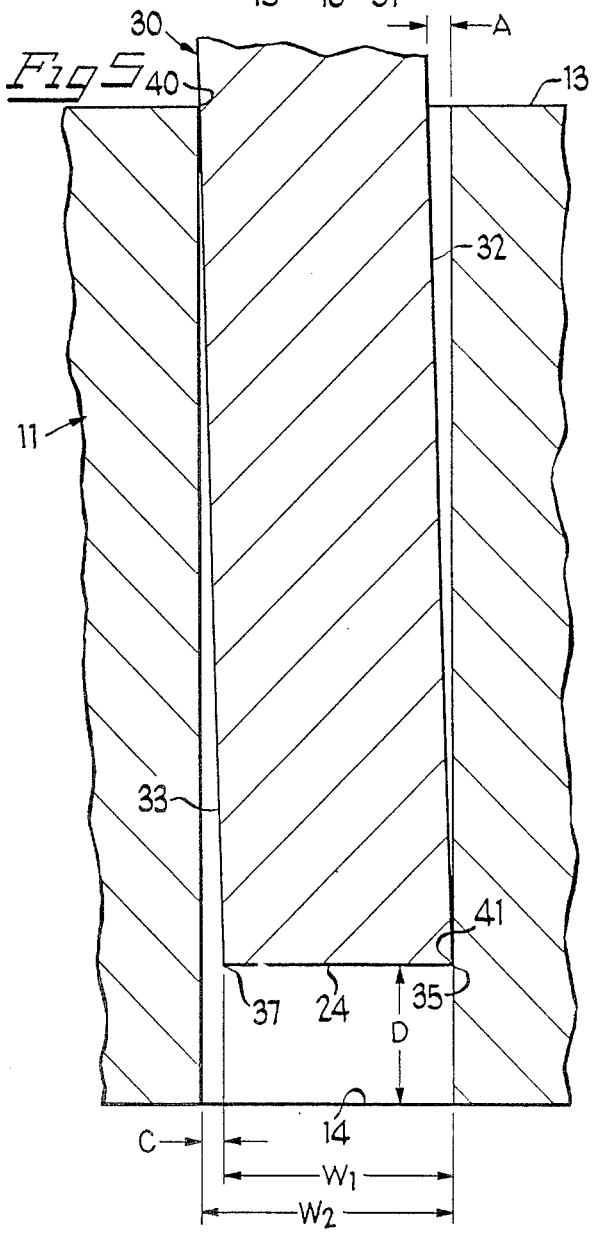
FIG. 5 is a fragmentary view in vertical section taken along the line 5—5 in FIG. 4.

Referring to FIGS. 3–5, there is illustrated a driven member in the form of a fastener 10, which in the illustrated embodiment is a socket-head fastener, such as a screw or bolt. The fastener 10 has an enlarged head 11 provided with an axial recess 12 in the end surface 13 thereof. The recess 12 is of uniform depth throughout its entire cross-sectional area and has a flat bottom surface 14 (see FIG. 5). The recess 12 is provided with six radially outwardly extending lobes 15 equiangularly spaced apart around the longitudinal axis of rotation of the fastener 10, the lobes 15 all being identically shaped and extending the full depth of the recess 12. Each of the lobes 15 includes an arcuate tip portion 16 and arcuate side wall portions 17 (FIGS. 3 and 4), the arcuate side wall portions 17 of adjacent lobes 15 forming parts of a common part-cylindrical surface which extends between the two lobes.

Figure 1:
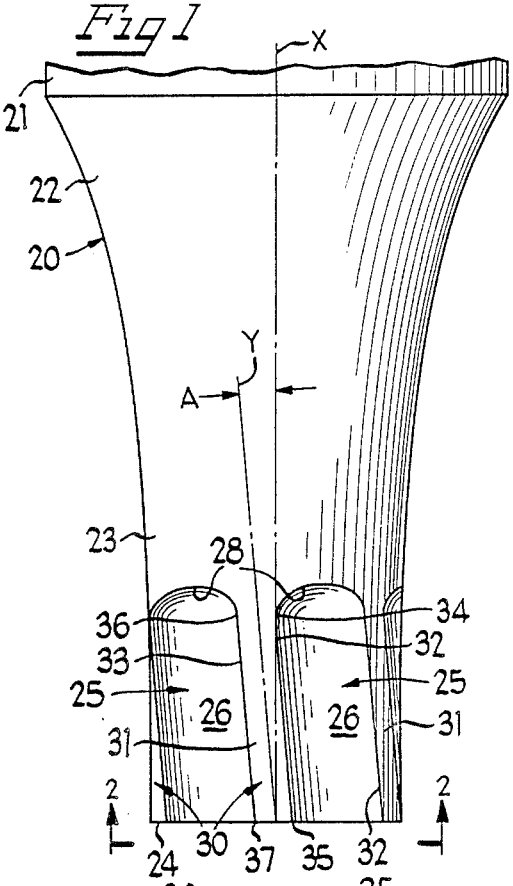
FIG. 1 is a fragmentary, side elevational view of the bit portion of a rotatable driving tool, constructed in accordance with and embodying the features of the present invention.
Figure 2:
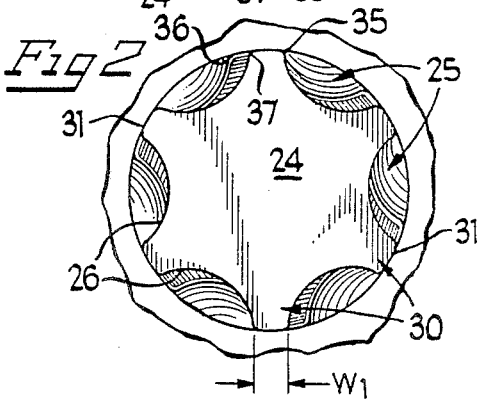
FIG. 2 is a bottom plan view of the bit portion of the tool of FIG. 1.

Referring also to FIGS. 1 and 2, there is provided a rotatable driving tool, generally designated by the numeral 20, which includes a shank 21 provided at its distal end with a bit 22. The bit 22 tapers to a circularly cylindrical tip 23, which has a longitudinal axis of rotation X and terminates in a flat end face 24 disposed perpendicular to the axis X. Formed in the cylindrical surface of the tip 23 are six equiangularly spaced-apart and identically constructed concave depressions or grooves 25, each of which defines a part-cylindrical surface 26 which has an axis inclined with respect to the axis X and which extends longitudinally of the tip 23 from the end face 24 to an inner end 28.

The grooves 25 cooperate to define six equiangularly spaced-apart and identically constructed driving portions or blades 30, each having a part-cylindrical outer peripheral surface 31 which forms a part of the cylindrical surface of the tip 23 and is bounded by parallel side edges 32 and 33 Each of the blades 30 is substantially circularly helical, having a predetermined helix angle A (see FIGS. 1 and 5). The helix angle A is illustrated in FIG. 1 as the angle between a side edge 32 of one of the blades 30 and the projection of the axis X onto the surface of the cylindrical tip 23. Thus, it will be appreciated that the cylindrical tip 23 of the tool 20 is generally in the shape of a helical gear.

Referring in particular to FIG. 1, it can be seen that each of the side edges 32 extends from an inner end point 34, at which it joins the adjacent one of the ends 28, to an outer end point 35 at the end face 24. Similarly, each of the side edges 33 extends from an inner end point 36 to an outer end point 37. As indicated above, the end points 34 and 36 are spaced apart the same distance $W_1$ as are the end points 35 and 37, this distance being the width of the blade 30. This width is less than the width $W_2$ of the arcuate tip portion 16 of each of the lobes 15 of the recess 12 by a clearance distance C (FIG. 5).

The longitudinal extent of the blades 30 and the magnitude of the helix angle A are such that the end points of either one of the side edges 32 and 33 of a blade 30 are offset from each other in directions substantially normal to the axis X a distance O (FIG. 2). which is greater than the clearance distance C. Accordingly, when the bit 22 of the tool 20 is inserted in the recess 12 of the fastener 10, the blades 30 will wedge into an interference fit in the lobes 15 before the bit 22 bottoms out in the recess 12. More specifically, referring to FIGS. 4 and 5, the trailing side edges 33 of the blades 30 may slide along engagement points 40 at the outer ends of the lobes 15, until the end points 35 engage the opposite sides of the lobes 15 at engagement points 41, spaced a predetermined distance D from the bottom surface 14 of the recess 12. Thus, it will be appreciated that each blade 30 wedges into interference engagement with the opposite side walls of the associated lobe 15 at the engagement points 40 and 41, and the application of an axial force on the tool 20 will wedge the bit 22 into firm engagement with the fastener 10, securely to retain the fastener 10 on the tool 20.

Preferably, the parts are arranged so that the distance D is small enough to permit a significant depth of insertion of the bit 22 into the recess 12 to insure sufficient longitudinal spacing between the engagement points 40 and 41 to attain an efficient transfer of the torque from the driving tool 20 to the fastener 10. At the same time, the distance D must be large enough to prevent bottoming out of the bit 22 in the recess 12 even after wear of the parts resulting from repeated usage. In a preferred embodiment of the invention the distance D may be in the range of from about 15% to about 25% of the overall depth of the recess 12.

It will further be appreciated that the total wedging force tending to retain the fastener 10 on the tool 20 is related to the axial force applied to the tool 20. Also, up to a point, the conversion of axial force to lateral wedging force is inversely proportional to the magnitude of the helix angle A. It has been determined that if the helix angle A becomes too large there is no longer an effective wedging action. In the case of a six-bladed tool 20, it has been found that if the helix angle A exceeds six degrees, effective wedging action may be lost. In a constructional model of the six-bladed embodiment of the invention disclosed in the drawings, it has been found that optimum results are attained with a helix angle of about 2.5 degrees, but in general it is believed that various helix angles in the range of from about one degree to about six degrees will work satisfactorily, depending upon the configuration of the fastener 10 and tool bit 22.

The operation of the present invention to securely retain the fastener 10 on the tool 20 will be effective irrespective of the direction of rotation of the tool 20 in driving the fastener 10. However, the retention effected by the invention may be greater in one direction of rotation than another, depending upon the direction of inclination of the blades 30 with respect to the axis of rotation X. Thus, for example, in the embodiment illustrated in the drawings, rotation in a counterclockwise direction may have a tendency to "screw" the tool bit 20 into the recess 12, thereby tending to enhance the wedging action.

In a constructional model of the invention, the depth of the recess 12 and the longitudinal extent of the cylindrical tip 23 of the tool 20 are typically less than one-quarter inch, although it will be appreciated that this may vary depending upon the size of the fastener 10. The tool bit 22 is preferably formed of a suitable steel, while the fastener 10 may be formed of any desired material. When the fastener 10 is formed of a relatively soft material, such as brass or plastic, an increased angle A may be desirable to increase the amount of fastener deformation and, thus, the amount of wedging available to retain the fastener 10 on the tool 20.

While the present invention has been described above in connection with a six-bladed tool 20 for mating with a six-lobed fastener recess 12, it will be appreciated that other fastener and tool configurations could be used. Accordingly, any number of driving portions or blades 30 greater than two could be utilized. Furthermore, the driving portions need not necessarily be in the form of laterally projecting blades. Thus, for example, a generally flat-sided polygonal configuration, such as a hexagonal configuration, could be used. If fewer than six driving portions or blades are used, a larger helix angle A may be desirable.

From the foregoing, it can be seen that there has been provided an improved rotatable driving tool and an improved assembly of tool and cooperating fastener which effectively retains the fastener on the tool, while still providing an efficient transfer of torque from the tool to the fastener, irrespective of the material of the fastener.

I claim:

1. A rotatable driving tool for imparting torque to a driven member, the tool comprising: a body having a longitudinal axis of rotation, and a plurality of driving portions projecting laterally from said body and equiangularly spaced about said axis, each of said driving portions having non-planar surfaces meeting to form an outer edge which defines a portion of a substantially circular helix having a helix angle less than six degrees, where a helix is a non-planar curve.

2. The driving tool of claim 1, wherein said body includes six of said driving portions.

3. The driving tool of claim 1, wherein each of said driving portions is in the form of a longitudinally elongated blade, said blades being separated by axially elongated concave grooves formed in said body.

4. The driving tool of claim 3, wherein said blades are respectively provided with outer peripheral surfaces which lie along a common circular cylinder.

5. The driving tool of claim 1, wherein the axial extent of said driving portions is less than one-quarter inch.

6. The driving tool of claim 1, wherein said helix angle is no greater than about six degrees.

7. The driving tool of claim 1, wherein said helix angle is in the range of from about one degree to about three degrees.

8. A rotatable driving tool for imparting torque to a rotatable driven member about an axis of rotation, the driven member having formed therein an axial recess having a plurality of equiangularly spaced-apart lobes each extending the full axial extent of the recess and having a longitudinal axis, said tool comprising: a body adapted to be received coaxially in the recess of the driven member, and a plurality of longitudinal driving portions on said body equal in number to and respectively receivable in the lobes when said body is received in the recess, each of said driving portions having a longitudinal axis inclined with respect to the longitudinal axis of the associated lobe and non-coplanar with the axis of rotation when said body is received in the recess, each of said driving portions having non-planar surfaces meeting to form an outer edge which defines a substantially circular helix, where a helix is a non-planar curve, whereby each of said driving portions engages in the associated lobe at longitudinally spaced-apart locations in a wedging interference fit to retain the driven member in engagement with said driving tool.

9. The driving tool of claim 8, wherein the longitudinal axis of each of said driving portions is inclined at an angle less than five degrees with respect to the longitudinal axis of the associated lobe.

10. The driving tool of claim 8, wherein each of said driving portions has a longitudinal outer edge having end points which are offset from each other in directions substantially normal to the axis of rotation.

11. The driving tool of claim 8, wherein each of said driving portions is substantially circularly helical having a helix angle less than five degrees.

12. The driving tool of claim 8, wherein each of said driving portions is in the form of an axially elongated blade having a pair of longitudinal outer side edges disposed substantially parallel to each other.

13. In combination: a driven member having a longitudinal axis of rotation, said driven member having formed in one end thereof an axial recess having a plurality of equiangularly spaced-apart lobes, each of said lobes extending the full axial extent of said recess and having a longitudinal axis; and a rotatable driving tool having a body adapted to be received coaxially in said recess for imparting torque to said driven member, said body including a plurality of driving portions equal in number to and respectively receivable in said lobes when said body is received in said recess, each of said driving portions having a longitudinal axis inclined with respect to the longitudinal axis of the associated lobe and non-coplanar with the axis of rotation when said body is received in said recess, each of said driving portions having non-planar surfaces meeting to form an outer edge which defines a substantially circular helix, where a helix is a non-planar curve; whereby each of said driving portions engages in the associated one of said lobes at longitudinally spaced-apart locations in a wedging interference fit to retain said driven member in engagement with said driving tool.

14. The combination of claim 13, wherein said driven member is a threaded fastener.

15. The combination of claim 14, wherein said fastener is a socket-head screw wherein the socket defines said recess.

16. The combination of claim 13, wherein the longitudinal axes of said lobes are substantially parallel to said axis of rotation.

17. The combination of claim 13, wherein each of said driving portions is substantially circularly helical having a helix angle of less than five degrees.

18. The combination of claim 13, wherein each of said driving portions is in the form of an axially elongated blade having an outer peripheral surface bounded by substantially parallel side edges spaced apart by a distance which is less than the width of the associated lobe by a predetermined clearance distance, the opposite ends of each of said edges being offset from each other in directions substantially normal to the axis of rotation a distance greater than said clearance distance.

19. The combination of claim 13, wherein each of said driving portions is shaped and arranged so as to engage in the associated one of said lobes at two locations, the innermost one of which is spaced a slight distance from the inner end of said recess to insure a wedge fit.

20. A combination of claim 13, wherein the number of said lobes and said driving portions is six.

* * * * *